US006250562B1

(12) United States Patent
Bruyn

(10) Patent No.: US 6,250,562 B1
(45) Date of Patent: Jun. 26, 2001

(54) RESILIENT CAPS FOR CROSS-TIES AT RAILWAY CROSSINGS

(75) Inventor: Dominicus Bruyn, Cambridge (CA)

(73) Assignee: Performance Polymers Inc., Cambridge (CA)

( * ) Notice: Subject to any disclaimer, the term of this patent is extended or adjusted under 35 U.S.C. 154(b) by 0 days.

(21) Appl. No.: 09/382,954

(22) Filed: Aug. 25, 1999

(30) Foreign Application Priority Data

Aug. 25, 1998 (CA) ..... 9818466

(51) Int. Cl.[7] ..... E01B 1/00

(52) U.S. Cl. ..... 238/8; 238/2

(58) Field of Search ..... 238/2, 8, 9

(56) References Cited

U.S. PATENT DOCUMENTS 4,267,969 * 5/1981 Hales et al. ..... 238/8
5,181,657 * 1/1993 Davis ..... 238/8
5,513,797 * 5/1996 Lesley ..... 238/9

* cited by examiner

*Primary Examiner*—Stephen Avila
*Assistant Examiner*—Robert J. McCarry, Jr.
(74) *Attorney, Agent, or Firm*—Anthony Asquith & Co

(57) ABSTRACT

Pre-cast concrete panels are commonly provided at road-rail crossings, to serve as the roadway, but such panels have been liable to premature failure. Rubber caps are placed over the cross-ties, between the panel and the ties, to isolate the panel from the stresses that arise when the panel contacts the ties directly. The caps are ribbed. Two kinds of ribs are provided, some solid and rectangular, others triangular and hollow. The ribbed panels provide resilience and hysteresis over a range of conditions, to prevent fretting and cracking of the panel.

15 Claims, 6 Drawing Sheets

RESILIENT CAPS FOR CROSS-TIES AT RAILWAY CROSSINGS

At road/rail crossings, it is known to provide a concrete panel or slab. The panel is placed in the space between the railway lines, and serves as the roadway between the railway lines. The panel rests on top of the cross-ties. Sometimes, such panels have failed prematurely.

BACKGROUND OF THE INVENTION

The concrete panel is not loaded at all (other than by its own weight) when a train passes through the crossing. The loading of the panel occurs due to trucks and other vehicular road traffic passing over the crossing.

When a heavy truck passes over the crossing, the panel is subjected to bending stresses, in that the panel tends to deflect downwards between those points where the panel touches the cross-ties. In a case where the cross-ties are uneven, the panel might bridge over several cross-ties without actually touching. That is to say, the underside of the panel rests on the high-standing cross-ties, but is clear of the low-standing cross-ties.

If the panel is flexible enough, under a heavy road-traffic load, the panel might deflect so far that the undersurface of the panel touches the tops of the low-standing intermediate cross-ties. Once the panel touches the tops of the low-standing cross-ties, the panel is now supported by that cross-tie, and no further downwards deflection of the panel takes place.

The conditions that lead to premature failure occur when the cross-ties are unusually uneven. Given that all the cross-ties are mounted at exactly the same heights at their rail-attachment points, it might be considered surprising that the top surfaces of the cross-ties are not all at exactly the same heights, i.e that the top surfaces of the ties do not all lie in exactly the same flat, horizontal plane. However, there are a number of reasons for the unevenness. First, concrete cross-ties are moulded, and usually come from several different moulds, and the mould-maker would not have paid particular attention to getting all the moulds exactly equal. Also, the (moulded) concrete panel itself is large, and heavy, and its undersurface might not be completely flat. Also, some ties have writing embossed on the top surfaces. Concrete panels and concrete ties have metal reinforcing bars 1st into the concrete, and the bars can give rise to a slight distortion of the concrete components.

Naturally, the designer of the system takes account of the maximum unevenness of the tops of the cross-ties, and sees to it that the amount of stress the panel might undergo, in bending, will not cause the panel to fail. However, the panels still do seem to fail, and the notion has arisen that there must be some unknown factor affecting failure of the panels. Concrete panels are disfavoured by many railroad companies for this reason.

This is a pity, because concrete panels have the benefit that they can be installed quickly. One of the factors when working at road-rail crossings is that the crossing has to be closed—certainly to road traffic if not to rail traffic—for the period while the work is being done. One-piece panels offer the possibility that the panel can be pre-manufactured and brought to the site, and then the panel is simply hoisted up and lowered into position between the rails. The commercially-practical alternative to the one-piece concrete panel is to apply asphalt between the rails; however, where the one-piece panel takes just minutes to install, a corresponding asphalt installation takes hours. If only the concrete panels could find favour, on-site work could be carried out more quickly, and with pre-manufactured components, which would keep the on-site labour costs (and unpredictabilities) to a minimum.

The invention is aimed at providing a system for capping the cross-ties, in order to alleviate the problems of premature failure of the concrete panels.

GENERAL FEATURES OF THE INVENTION

The invention lies in providing ribbed caps of rubber, or other elastomeric material, between the panel and the cross-ties. The ribbed caps act to safeguard the panel from the stresses that would arise if the panel were in direct contact with the cross-ties.

DESCRIPTION OF PREFERRED EMBODIMENTS

The invention will now be described, by way of example, with reference to the accompanying drawings, in which.

Some of the structures shown in the accompanying drawings and described below are examples which embody the invention. It should be noted that the scope of the invention is defined by the accompanying claims, and not necessarily by specific features of exemplary embodiments.

Figure 1:
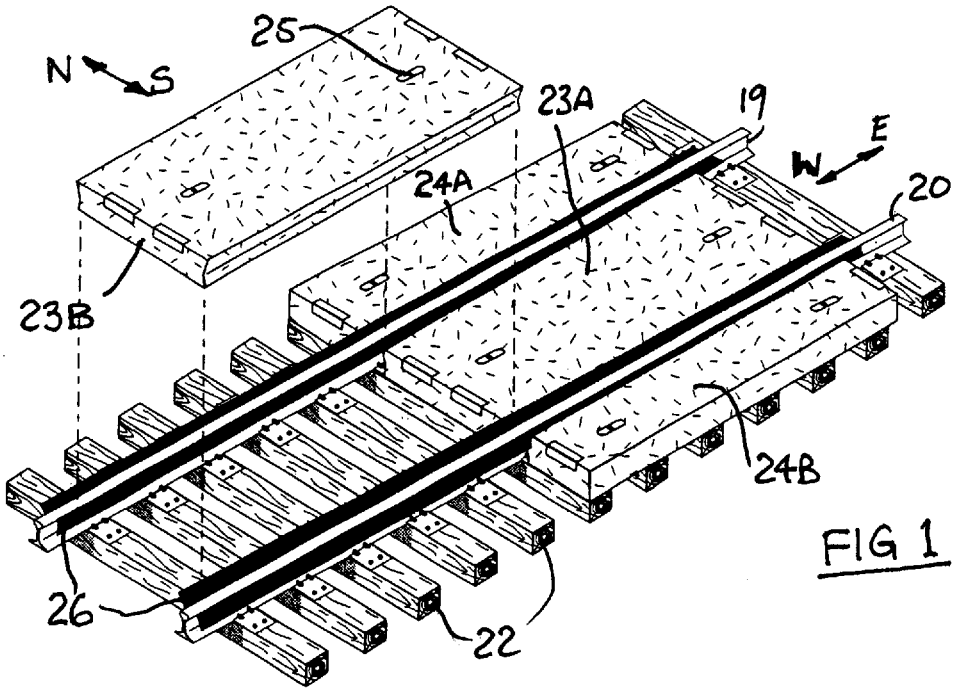
FIG. 1 is a diagrammatic view showing the use of concrete panels at a road-rail crossing, in which the rail tracks run east-west, and the road runs north-south.
Figure 2:
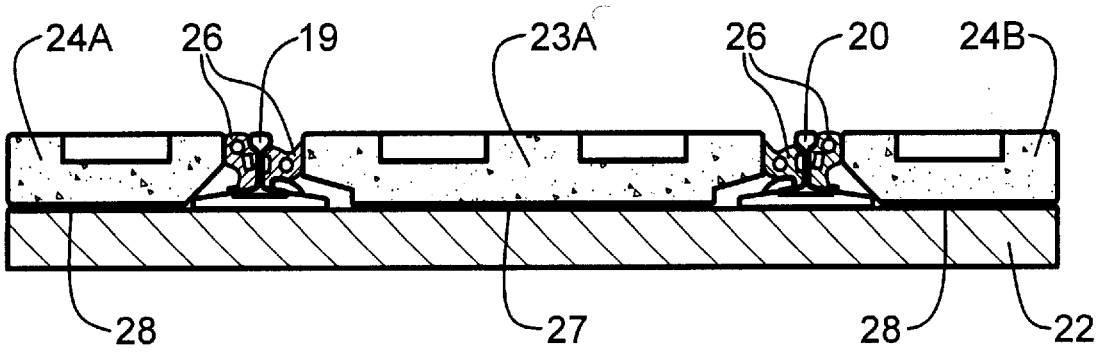
FIG. 2 is a cross-section of a road-rail crossing, looking in the east-west direction, along the rail tracks.

The crossing shown in FIG. 1 includes a railway (running east-west), having rails 19,20 supported on cross-ties 22, which are set into ballast (not shown) in the usual way. A road 24 runs north-south, and in the vicinity of the crossing the road is constituted by concrete panels. In this case, the road is so wide that two panels 23A,23B have been placed between the rails 19,20, end to end. Other panels 24A,24B have been placed outside the rails, to link with the asphalt, or concrete, etc, of the roadway itself. The panels 23A,23B between the rails are termed the gauge-panels, and the panels 24A,24B outside the rails are termed the field-panels. The concrete panels are lowered into place with a hoist, hook-eyes 25 being provided for the purpose. It is conventional to provide rubber insert-strips 26 between the panels and the rails, as shown in FIG. 2.

Figure 3:
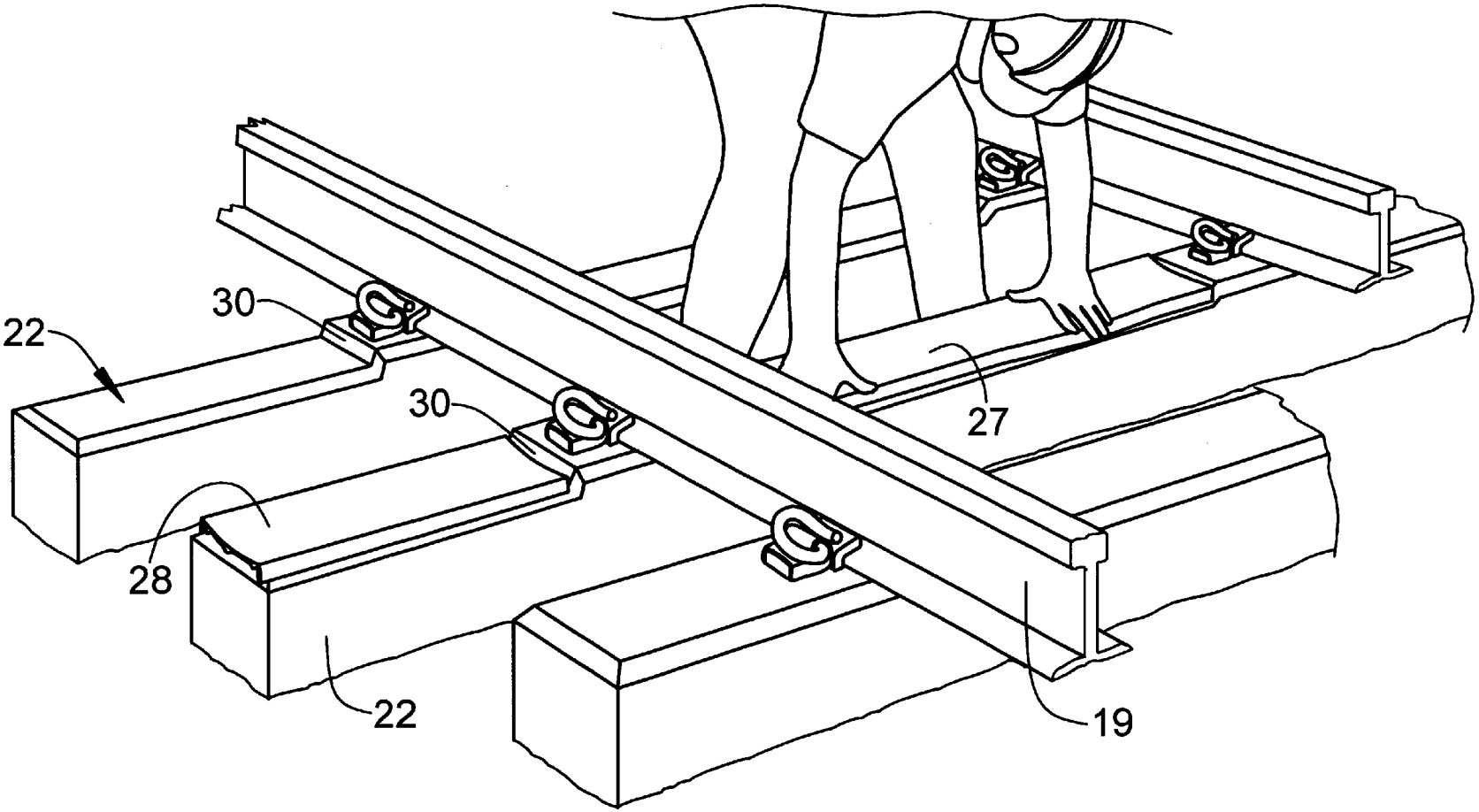
FIG. 3 is a pictorial view of a road-rail crossing, during construction/maintenance thereof, in which rubber pads in accordance with the invention are being installed on top of the cross-ties.
Figure 4:
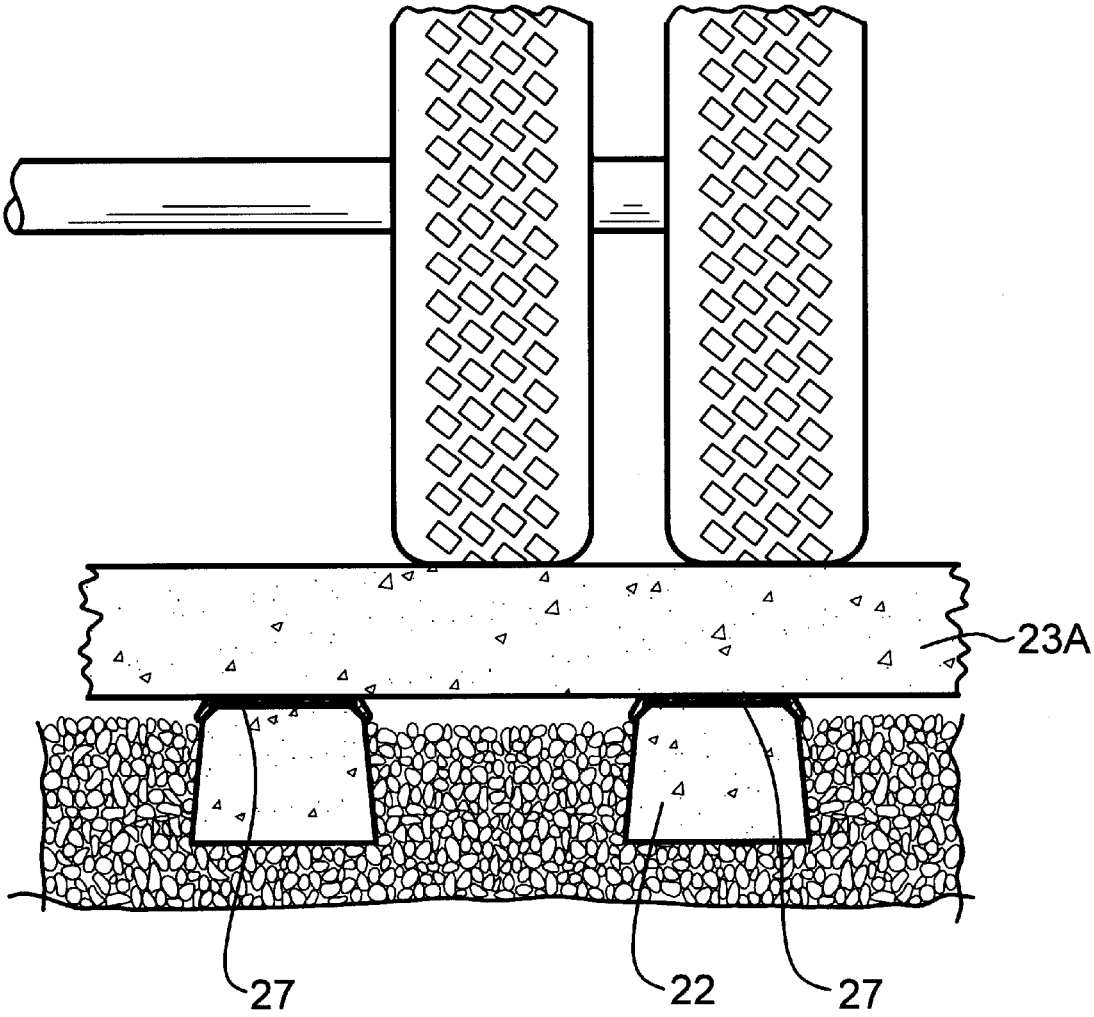
FIG. 4 is a cross-section of a road-rail crossing, looking in the north-south direction, along the road.

The rubber caps of the invention are placed over the tops of the cross-ties. As shown in FIG. 3, gauge caps 27 are placed on the cross-ties between the rails, and field caps 28 are placed on the ties outside the rails. As shown in FIG. 3, the cross-ties 22 at the crossing are a little longer than the cross-ties of the rest of the railway track, away from the crossing.

The rubber caps 27,28 are placed on top of the cross-ties. It is important that the caps be correctly placed, and that the caps do not move, once they have been installed in position. The caps may be pre-installed on the concrete ties, and secured with adhesive, before the ties themselves are installed, if the railway is being constructed from new. Or, the caps may be glued in place upon being placed on already-installed cross-ties. However, gluing is not favoured as an operation to be carried out on-site, i.e actually at the crossing, and preferably the caps are held in position on the cross-ties by virtue of the shape of the caps.

The caps 27,28 must be held against movement relative to the cross-tie 22; in the east-west direction, this is done by providing end-flaps 29 on the caps, which engage with the side edges of the ties. It should be noted that it is important that the cap be maintained and held in its correct location on the tie; if the cap were to become displaced out of position on top of the tie, the panel might become especially liable to premature failure.

The caps 27,28 also need to be properly held in position in the north-south sense. It may be noted that some designs of cross-ties 22 have shoulders 30, and these shoulders can be used to hold the caps in position in the north-south sense. The shoulders 30 are present on both the field side and the gauge side of the rails. The field-side caps 28 are prevented from being displaced north-south off the ends of the cross-ties by the ballast, and by the asphalt or other pavement material of the road.

Figure 5:
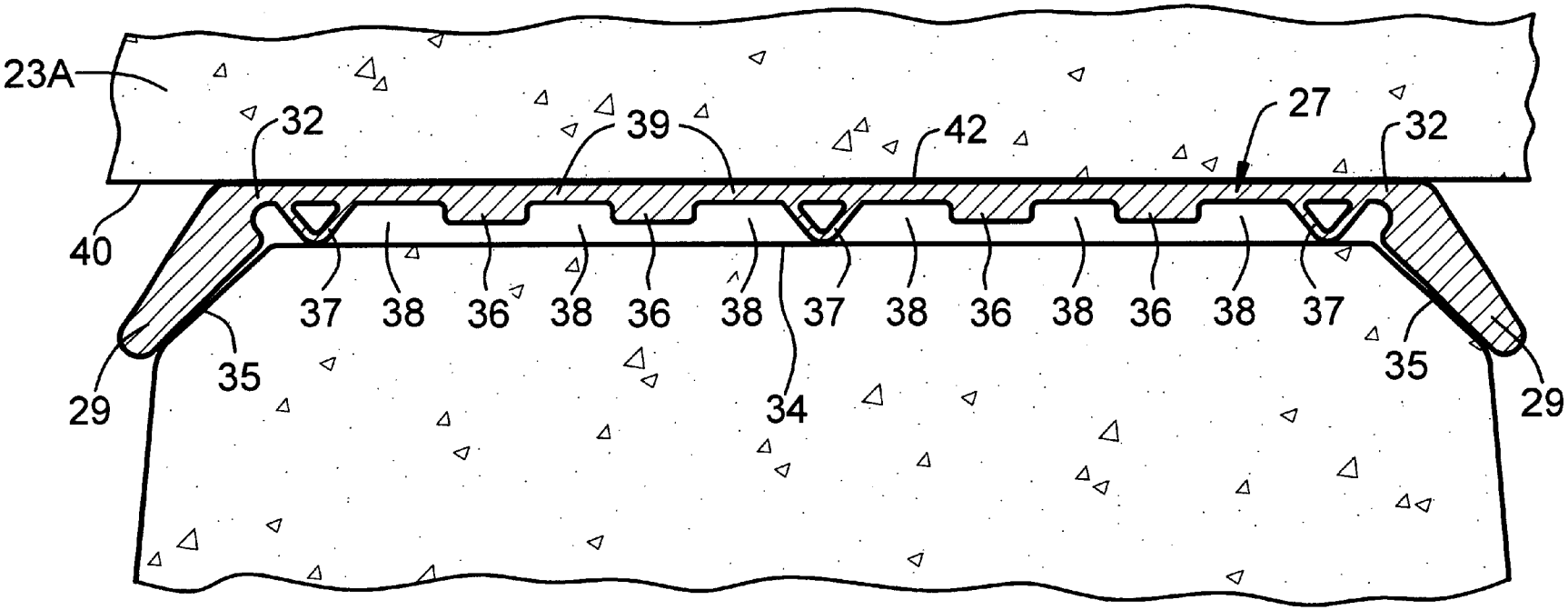
FIG. 5 is a cross-section of the profile of an extruded rubber cap component, shown in position on top of a low-standing cross-tie.

In profile of the caps 27,28, as shown in FIG. 5, the end-flaps 29 are thick and chunky, but are attached to the main body of the cap by a relatively thin hinge-portion 32. Thus, the end-flaps can orientate themselves to the top surface 34 of the cross-tie. Concrete cross-ties usually have a chamfer 35 at the edges of the top surface, and this chamfer can vary, tie to tie (since the ties come from different moulds). The combination of a chunky form of the end-flap with a flexible hinge enables the cap to centre itself snugly on the tie, and to be held in position securely, once in place, even though the ties might have (slightly) different configurations as to their upper surfaces 34.

The caps 27,28 are manufactured as extrusions. The extruded profile is as shown in FIG. 5, which is the profile looking along the extruded length of the cap, in the north-south direction. The caps have the same profile at all sections along their length.

Figure 6:
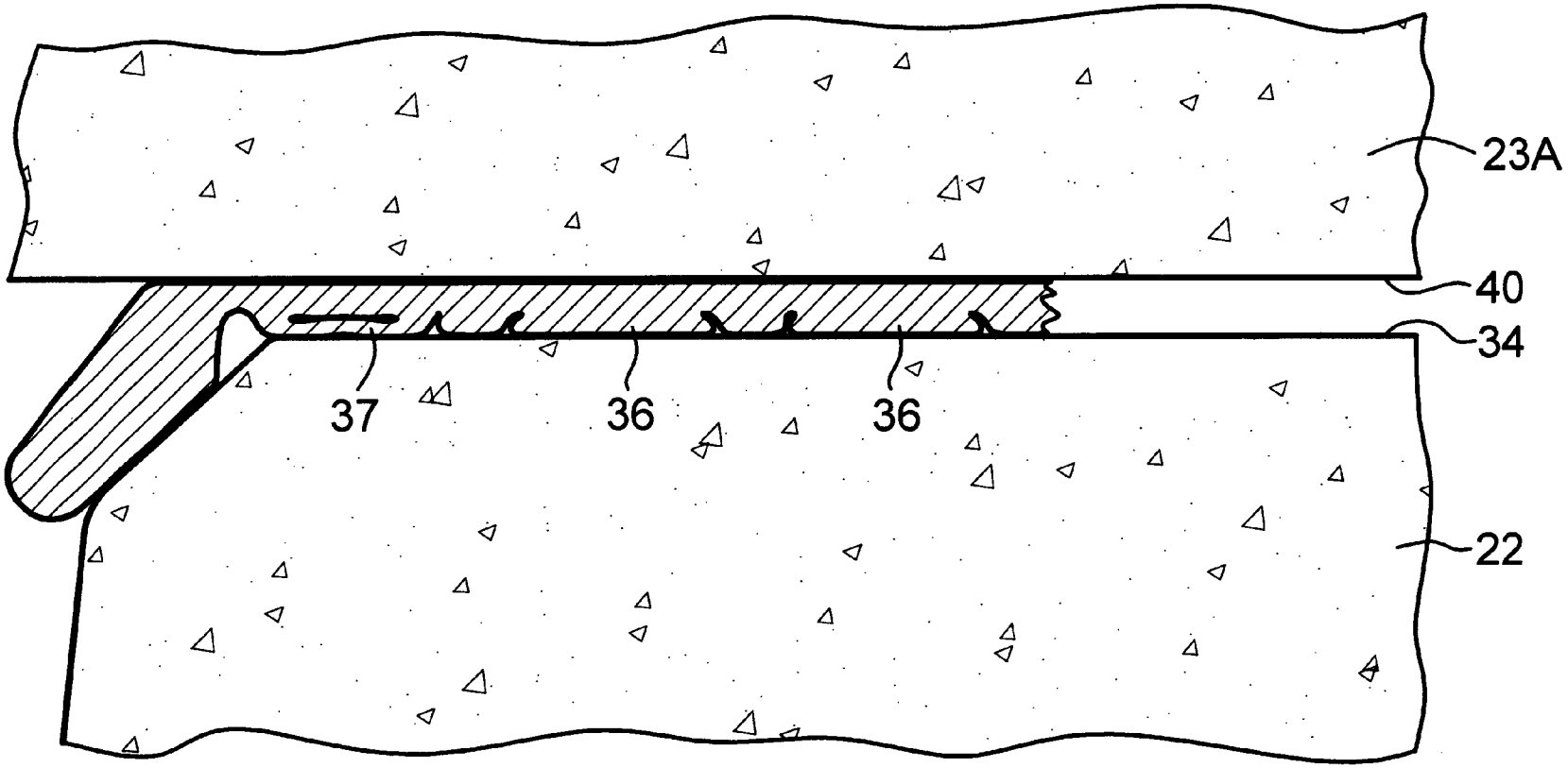
FIG. 6 is the same cross-section as FIG. 5, except that the rubber cap has been compressed to a maximum extent.

FIG. 5 shows the as-extruded profile of the cap. The profile includes four solid rectangular ribs 36 and three hollow triangular ribs 37. The solid ribs are termed A-ribs and the hollow ribs are termed B-ribs. FIG. 6 shows the condition of the cap when subjected to heavy compression. The material of the A-ribs 36 has been able to expand sideways into the spaces 38 between the ribs. It may be noted that in the condition shown in FIG. 6, virtually all the open spaces (FIG. 5) between the panel 23A and the tie 22 have been taken up by the lateral deflections and distortions of the compressed rubber. Therefore, if any further compression of the rubber were to be attempted, beyond the FIG. 6 conditions, the rubber would be bottomed out.

Rubber of course has a low modulus of elasticity, in compression. But this low modulus only applied when the compression of the rubber in one direction can be accommodated by corresponding expansions of the rubber in another direction; for example, that when rubber is compressed vertically, it can expand horizontally. That is to say, the low modulus of rubber only applies when the overall volume of the body of rubber does not change (much) during the compression.

But when the body of rubber is confined, such that the rubber cannot expand to accommodate the compression, any further compression of the rubber then can only take place in the bulk-compression mode, i.e when the rubber must reduce in volume, in proportion to the compression, in order for the compression to take place. The modulus in that case is the bulk-modulus; and though rubber is a material that has a much lower modules of elasticity than other solid materials, its bulk-modulus is comparable with that of other solid materials, like wood, concrete, etc.

Therefore, further compression, beyond the FIG. 6 condition, would entail a sudden increase in the resistance to the compression, and in fact the resistance to further compression then would be hardly any less than if the panel were contacting directly against the cross-tie.

Thus, the A-ribs 36 as shown have the property of being at first compressible, and of thereby allowing the panel to bend downwards; and yet there is a limit to the amount of the compression (and thereby to the amount of the bending of the panel), in that once the ribs bottom out (beyond FIG. 6) the cap effectively becomes solid with the cross-tie, and, practically, no further bending of the panel takes place.

If the space 38 between the ribs were too small, the ribs would bottom, and the cap would become solid, too quickly. If the space were too large, the ribs would not bottom out at all, and the panel might then be able to be overstressed due to the bending alone. Where the base layer or matrix 39 of the cap is about half the vertical thickness of the A-ribs 36, as shown in FIG. 5, the widths of the spaces 38 between the ribs should be approximately equal to the widths of the ribs themselves. The limits are that the widths of the spaces should be within about ½ and 1½ times the widths of the A-ribs.

The hollow triangular ribs 37 are the B-ribs. When compressed, these ribs are able to collapse inwards, and to collapse by folding and buckling of the rib walls. Therefore, the resistance of these ribs to being compressed is considerably less than the resistance of the solid A-ribs. Thus, the A-ribs and the B-ribs offer, in combination, at first a fairly low resistance to compression, from the B-ribs on their own (the A-ribs not yet being under compression); then, as both ribs are brought to bear, the rate of resistance to further compression increases; then, finally, as the ribs bottom out, the rate of resistance to further compression becomes almost as large as if the panel were resting on the cross-tie directly.

It is recognised that this characteristic (which arises due to the presence of the ribbed caps) safeguards the concrete panel from most of the abusive stresses that in the past have led to premature failure.

The caps also act to safeguard the concrete panels in another way, as follows.

Consider the case where there are no caps, and where the panel lies well clear of a particular low-standing tie. When a heavy truck passes over, the panel bends downwards. This puts the top surface of the concrete panel under compression, and the bottom surface 40 of the panel under tension.

However, as the panel deflects (bends) further downwards, the panel deflects enough that the undersurface 40 of the panel strikes the top surface 34 of the tie. It should be noted that this striking of the panel and the tie together takes place at a time when the undersurface 40 of the panel is under heavy tensile stresses. That is to say, the undersurface of the panel is under heavy tensile stress at the time when it makes contact with the tie.

As a result of repeated such contacts, the undersurface 40 of the panel starts to fret. The fretting can lead to small cracks, and the small cracks then propagate. This can lead to failure of the panel, after a period of such fretting and cracking, even though the nominal stresses acting on the panel are well within the stress limits that the panel can theoretically support.

Thus, the panel fails prematurely, even though the panel might never have been overstressed. Even at the lowest of the low-standing cross-ties, the tie is so close underneath the panel that little actual bending of the panel is required before the panel contacts the tie. And, once the panel contacts the tie, no further bending takes place. So, it is not the bending stress as such that causes the panel to fail. Rather, it is the fact that the undersurface of the panel strikes against the tie at a time when the undersurface 40 of the panel is under tensile stress. It is the repeated strikes against the stressed undersurface that lead to the fretting, and subsequent premature failure, of the panel.

The presence of the rubber caps between the panel and the cross-ties is aimed at preventing the contact from being disruptive. The undersurface of the panel now directly contacts the soft, resilient rubber, rather than the hard concrete of the tie. Even if the rubber should bottom out, so the panel is now supported solidly, the rubber, even in bulk compression, is still easier on the stressed undersurface of the panel than the cross-tie itself would be.

In addition, the rubber cap has a high degree of hysteresis, upon being compressed and released. The stresses on the panel are caused by heavy trucks passing over the crossing. The truck wheels roll over the panel; this is a manner of applying loads to the panel that exacerbates any tendency of the panel to move and rock, and even bounce, on the uneven ties. The truck wheel does not simply apply its load gently and progressively, and then take its load off gently and progressively. Thus, the rolling wheels can be expected to cause the panel to vibrate and shake violently as it bends and makes its contact with the tie. This is much worse, from the fretting point of view, than if the panel did receive the weight of the truck progressively and gently.

The rubber cap, being not only resilient, but also having a high degree of hysteresis, in its compressions, has the effect of making it seem as if the load was applied gently and progressively.

The hysteresis comes from the fact that the vertical compression of the ribs 36,37 is accompanied by the horizontal expansion of the ribs, and that such expansion involves the material of the ribs moving against itself and against the undersurface 40 of the panel and the uppersurface 34 of the cross-tie. Thus, as the load increases, the friction opposes the increasing compression. When the load is released, the frictional resistance acts in reverse, and opposes the release of the compression. Thus, the hysteresis damps out the spikes or peaks of loading, and the shocks and vibrations, associated with the fact that the load is applied to the panel by a truck-wheel rolling over the panel.

The solid A-ribs and the hollow B-ribs not only have different modulus of elasticity, but they also have different hysteresis characteristics. This is advantageous in protecting the panel over a wide range of conditions. At most crossings, very heavy trucks are not the real problem, because they are uncommon. The damage in those cases is done by the lighter trucks, which pass over much more frequently. Therefore, it is important that hysteresis be available, from the ribs, not only at heavy loadings, but also even at quite low loadings, and the caps as shown, with their hollow B-ribs, have that capability.

As mentioned, the rubber caps 27,28 are extruded. Extrusion is a preferred manner of manufacture, because components for road-rail crossings can never be manufactured as a high volume production item, and extrusion, as a process, is less expensive than, for example, compression-moulding, and much less than injection-moulding, for low-volume production.

The profile of FIG. 5 is about 22 cm long, and flat and thin, and the extrusion of profiles of that shape and size is inexpensive, and easy to control as to its curing and other parameters. For placement on top of a railway cross-tie, the gauge-cap needs to be about 125 cm long, and to be of constant cross-sectional profile along that length. The connection is recognised between the fact that such a profile is inexpensive and easy to extrude, in relatively small production quantities, and yet that manner of manufacture gives rise to a product that is admirably suited to ease of installation, and gives optimum performance once installed.

In the extrusion machine, the extruded profile emerges from the die onto a flat tray, where it starts to cure. If the profile were not supported properly by the flat tray, the profile might start to sag, and the sagging can be present in the final cured shape. If the profile is likely to sag, the designer might specify some shape other than a flat tray on which the emerging profile can take support, but that is expensive. It is better if the designer can devise a shape that is adequately supported by a flat tray. In the present profile (FIG. 5) the end-flaps are hinged. As extruded, the end-flaps have to be rather more upright than is dictated strictly by the shape of the cross-tie; otherwise, the end-flaps would sag down when curing. But the hinges 32 permit the end-flaps 29 to adopt the correct orientation later. Indeed, for the end-flaps to do their job of positioning the caps on the cross-ties, it is better that the end-flaps be over-steep rather than under-steep.

The fact that the ribs 36,37 protrude downwards means that the extrusion should be done upside down from FIG. 5, so the extruded profile emerges with the surface 42 going onto the extrusion tray.

Figure 7:
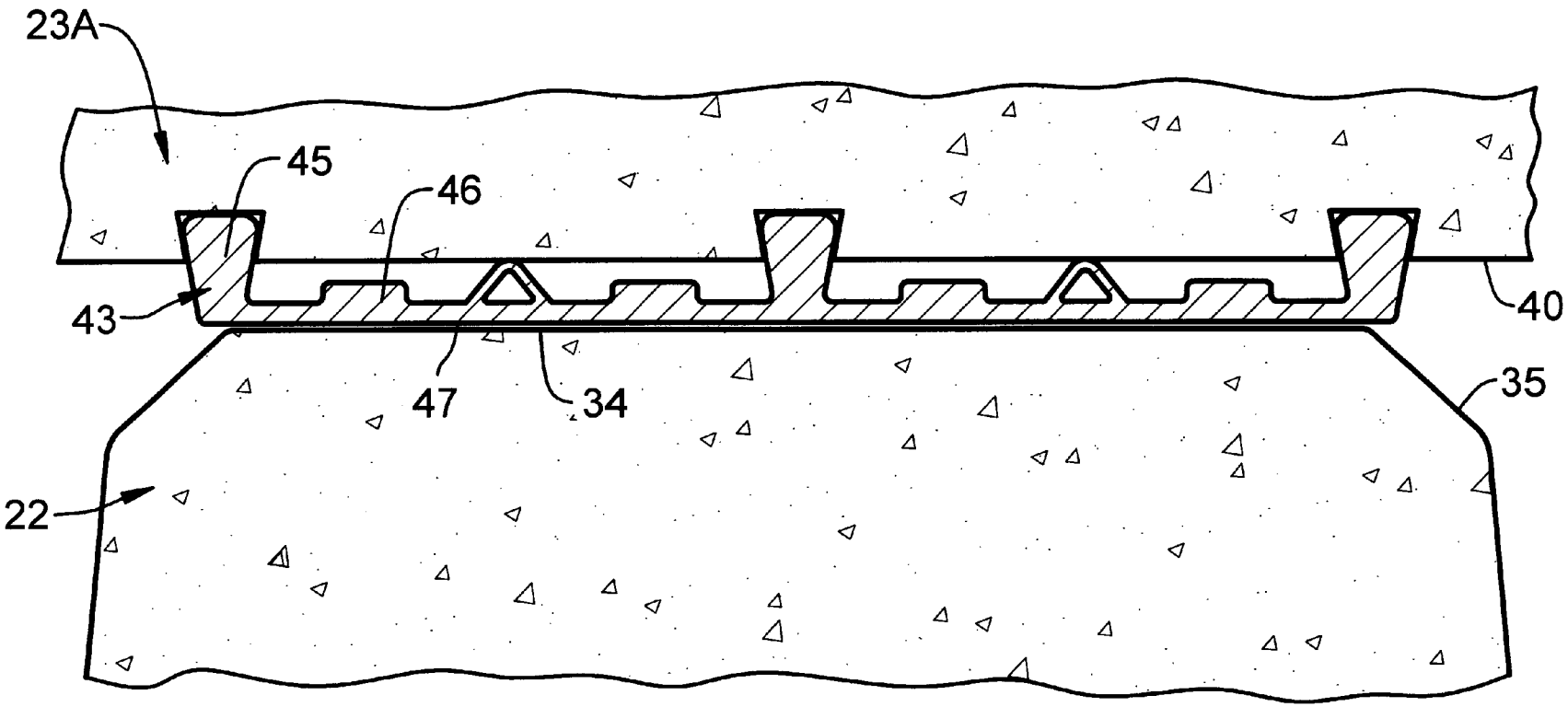
FIG. 7 is the same cross-section as FIG. 5 of another rubber cap, having a different extruded profile.

But the extrusion could be done the other way up. FIG. 7 shows a profile of cap 43 which includes dovetails 45. These dovetails engage corresponding slots (not shown) that are cast or moulded into the concrete pane. Now, the rubber caps 43 may be pre-attached to the panel, using the dovetails, prior to the panel being lowered down onto the ties. In this case, there is no need for end-flaps to position the caps. The ribs 46 can be made to protrude upwards, rather than downwards. The FIG. 7 profile would be extruded flat side 47 down, just as the FIG. 5 profile was extruded flat-side 42 down.

So long as the caps cover the cross-ties, it is not essential that the cross-ties each have their own individual respective caps (or rather, their own individual respective three caps, counting the gauge-cap and the two field-caps). The caps for several ties could be linked together as a continuous mat, if the designer so prefers. The intention is that the caps should cover virtually the whole upper surface of the cross-ties, or at least that portion of the upper surface of the cross-ties that is overlaid by the panel. However, in some cases, it might be preferred to leave some of the top surface of the cross-ties not covered by the caps. As mentioned, caps with the FIG. 5 profile, or similar, would be fitted with the extruded ribs contacting the tie, and the ribs being disposed along the length of the cross-tie, i.e in the north-south direction. However, in some cases the designer might prefer to have the ribs protruding upwards, or might prefer to have the ribs aligned in the east-west direction.

It should also be noted that the rubber cap can be embedded into the undersurface of the concrete panel. That is to say, the rubber component can be laid in the mould in which the panel is being cast. The caps need not necessarily be in single pieces of rubber material individual to each tie.

Similarly, the rubber caps can be dovetailed into prepared slots in the cross-ties; or, if the cross-ties are being newly moulded, the caps can be placed in the cross-tie moulds, whereby the caps become embedded in the as-cast ties.

The alignments are referred to as east-west and north-south for convenience, but these are just directions on paper. Of course, the polar alignment of the particular crossing, on the earth, has no bearing on whether the invention has been, or can be, applied at the crossing.

What is claimed is:

1. A set of caps for capping the cross-ties at a road-rail crossing, wherein:

at the crossing, the direction of alignment of the rail-tracks is termed the east-west direction, and the direction of alignment of the road is termed the north-south direction;

at the crossing, a concrete panel lies over, and rests on, the cross-ties;

the concrete panel is long enough, as to its east-west dimension, to span several of the cross-ties;

the concrete panel serves as a portion of the roadway, the panel being arranged to be rolled over by vehicular road traffic passing through the crossing, and the panel being arranged to transmit the weight of the traffic, through the panel, to the cross-ties underneath the panel;

the caps are of a resilient material;

the caps rest on the top surfaces of the cross-ties, disposed horizontally between the cross-tie and the under-surface of the concrete panel;

the caps are suitable for transmitting the weight of the concrete panel and of traffic passing over the panel, through the caps, to the top surfaces of the cross-ties;

each cap comprises a base layer, and a plurality of ribs;

the ribs are so structured as to be substantially distortable vertically, when compressed between the concrete panel and the cross-ties;

and the set of caps includes a means for holding the caps in place between the cross-ties and the panel.

2. As in claim 1, wherein in respect of some of the ribs, termed the A-ribs, the cap is so structured as to provide space horizontally alongside the A-rib for the elastomeric material of the A-rib to expand into, for the A-rib to increase in horizontal thickness;

whereby the A-rib is substantially not constrained, but is free to expand, as to its horizontal thickness, complementarily to accommodate vertical compression of the A-rib;

the general form of the A-rib, and its horizontal thickness, are such as to permit the A-rib to undergo a substantial reduction of its vertical height, when subjected to a vertical force compressing the A-rib between the panel and the cross-tie.

3. As in claim 2, wherein the A-rib is solid.

4. As in claim 1, wherein:

the cap, when not compressed, has a vertical thickness at the A-rib, of RT millimeters, the thickness RT being measured overall, including the A-rib and the base layer;

the A-rib is solid, and the said thickness RT of the cap at the A-rib obtains over a horizontal width of the A-rib of RW millimeters;

the horizontal width RW of the A-rib is greater than the vertical thickness RT of the cap at the A-rib, but is no more than about twice RT.

5. As in claim 4, wherein the A-rib has a substantially rectangular profile.

6. As in claim 3, wherein the horizontal space either side of the A-rib is at least half the width RW of the A-rib.

7. As in claim 1, wherein, in respect of some of the ribs of the cap, termed the B-ribs:

the B-rib is formed with a hollow cavity;

the B-rib and its cavity are so structured as to provide space inside the B-rib whereby the B-rib can collapse inwards;

and the hollow B-rib is of such shape and dimensions as to permit the B-rib to undergo a substantial reduction of its vertical height, when subjected to a vertical force compressing the A-rib between the panel and the cross-tie.

8. As in claim 7, wherein the B-rib has a triangular profile.

9. As in claim 1, wherein the ribs lie in a spaced-apart relationship, and are held located in that relationship by the base layer, and the base layer has a vertical thickness LH, in the horizontal space between the ribs, of less than about ¾ of RH.

10. As in claim 1, wherein the base layer is solid and the tops of all the ribs coincide with the top of the base layer to form a single flat surface.

11. As in claim 1, wherein the cap is formed from an extruded profile, cut to length.

12. As in claim 1, wherein the profile of the cap includes end-flaps, which are complimentary to the profile of the cross-tie, for positioning the cap on the tie.

13. As in claim 12, wherein the end-flaps have hinges, whereby the end-flaps can be orientated to lie snugly and securely over the exact profile of the cross-tie.

14. As in claim 1, wherein the caps cover the whole of the area of the upper-surfaces of the cross-ties lying underneath the panel, and nowhere does the concrete panel touch directly against the material of the tie.

15. As in claim 1, wherein the caps are provided in individual sets, respective to each cross-tie, comprising a guage cap and two field caps.

* * * * *